US009950359B2

(12) United States Patent
Sakuma et al.

(10) Patent No.: US 9,950,359 B2
(45) Date of Patent: Apr. 24, 2018

(54) ROTARY ROLLER SURFACE CLEANING METHOD AND ROTARY ROLLER SURFACE CLEANING APPARATUS

(71) Applicant: TOYOTA JIDOSHA KABUSHIKI KAISHA, Toyota-shi, Aichi-ken (JP)

(72) Inventors: Daisuke Sakuma, Nagoya (JP); Noriyuki Ueno, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 797 days.

(21) Appl. No.: 14/537,353

(22) Filed: Nov. 10, 2014

(65) Prior Publication Data

US 2015/0128989 A1 May 14, 2015

(30) Foreign Application Priority Data

Nov. 13, 2013 (JP) ..... 2013-234911

(51) Int. Cl.
*B22D 11/06* (2006.01)
*B08B 7/00* (2006.01)

(52) U.S. Cl.
CPC ..... *B22D 11/0665* (2013.01); *B08B 7/0042* (2013.01); *B22D 11/0611* (2013.01)

(58) Field of Classification Search
None
See application file for complete search history.

(56) References Cited

FOREIGN PATENT DOCUMENTS

JP 2001-041904 A 2/2001
JP 2008-073760 A 4/2008

*Primary Examiner* — Mikhail Kornakov
*Assistant Examiner* — Ryan L. Coleman
(74) *Attorney, Agent, or Firm* — Sughrue Mion, PLLC

(57) ABSTRACT

A rotary roller surface cleaning method and a rotary roller surface cleaning apparatus which, when foreign matter is detected on a surface of a rotary roller of a quenched ribbon manufacturing apparatus, remove the foreign matter by irradiating the foreign matter with a laser having an output value corresponding to a thickness of the foreign matter. At least one of a rotation speed of the rotary roller and a laser response time is adjusted such that the rotation speed of the rotary roller and the laser response time satisfy a relational expression $V \times S \leq D/1000$ ($D \geq 0.1$ mm), where the rotation speed of the rotary roller is V (m/sec), the laser response time is S (sec), and a length of the foreign matter along a circumferential direction of the rotary roller is D (mm).

12 Claims, 9 Drawing Sheets

ROTARY ROLLER SURFACE CLEANING METHOD AND ROTARY ROLLER SURFACE CLEANING APPARATUS

INCORPORATION BY REFERENCE

The disclosure of Japanese Patent Application No. 2013-234911 filed on Nov. 13, 2013 including the specification, drawings and abstract is incorporated herein by reference in its entirety.

BACKGROUND OF THE INVENTION

1. Field of the Invention

The invention relates to a rotary roller surface cleaning method and a rotary roller surface cleaning apparatus.

2. Description of Related Art

A rare earth magnet that uses a rare earth element such as a lanthanoid is also called as a permanent magnet, and is employed in a motor for a hard disk or a motor used in MRI, a drive motor for a hybrid vehicle or an electric vehicle, and so on.

Remanent magnetization (remanent magnetic flux density) and coercive force may be cited as indices of a magnet performance of a rare earth magnet. Increases in heat generation due to miniaturization and increased current density in motors have led to increased demand for heat resistance in rare earth magnets used in such motors. In response to this demand, research has been conducted into techniques for maintaining the coercive force of a magnet during use in high temperatures. With respect to an Nd—Fe—B magnet, which is a rare earth magnet frequently used in drive motors for vehicles, attempts have been made to increase the coercive force of the magnet by refining crystal grains, using an alloy with a composition containing a large amount of Nd, adding a heavy rare earth element exhibiting a superior coercive force performance, such as Dy or Tb, and so on.

Rare earth magnets include common sintered magnets in which the crystal grains (main phase) constituting the structure are on a scale of approximately 3 to 5 μm, and nano-crystal magnets in which the crystal grains are refined to a nanoscale of approximately 50 to 300 nm. Among these magnets, attention is currently focused on nanocrystal magnets, in which the required amount of expensive heavy rare earth elements can be reduced while refining the crystal grains.

A method of manufacturing a rare earth magnet can be described briefly as follows. For example, first, a molten metal (an Nd—Fe—B molten metal) of a rare earth magnet material is formed in a furnace, whereupon the molten metal is supplied from the furnace to a rotary roller. The molten metal is then rapidly solidified in order to manufacture a quenched ribbon (a quenched thin strip). Next, the quenched ribbon is cut into a desired size and formed into a magnet powder, whereupon the powder is sintered while being pressure-molded in order to manufacture a sintered body. In the case of a nano-crystal magnet, the sintered body is further subjected to hot plastic processing in order to apply magnetic anisotropy thereto, whereby a molded body is manufactured. A modified alloy constituted by an alloy containing a heavy rare earth element or an alloy not containing a heavy rare earth element, such as an Nd—Cu alloy, is applied to the molded body using one of various methods, whereby a rare earth magnet having an enhanced coercive force performance can be manufactured.

Incidentally, agglutinated material formed when the molten metal agglutinates may adhere to a surface of the rotary roller that quenches the molten metal. Further, irregularities may be formed on the surface of the rotary roller due to corrosion, dents, and so on, and the molten metal supplied from the furnace may be spattered by the agglutinated material and irregularities on the surface of the rotary roller. When the molten metal is spattered, the number of dents and the like on the surface of the rotary roller increases, and agglutinated material is more likely to adhere thereto.

For example, when foreign matter such as agglutinated material adheres to the surface of the rotary roller, the molten metal is not cooled sufficiently in a location where the foreign matter is adhered, and as a result, the quality of the manufactured quenched ribbon may deteriorate.

Hence, a method of stopping rotation of the rotary roller periodically, examining the surface of the rotary roller visually or the like, cleaning the surface when the existence of adhered foreign matter or the like is confirmed by removing the foreign matter, and then restarting rotation of the rotary roller in order to resume manufacture of the quenched ribbon may be employed. With this method, however, the rotary roller needs to be stopped periodically, and therefore the quenched ribbon cannot be manufactured efficiently.

Here, Japanese Patent Application Publication No. 2001-41904 (JP 2001-41904 A) describes a foreign matter removal apparatus that removes silver paste powder adhered to a transparent electrode of a touch panel by pressing a squeegee type pressing member against a surface of the touch panel in order to detect the position of the powder, controlling a linear motor in order to move an X-Y stage holding a CCD camera and a laser apparatus for removing the powder to the position of the powder, capturing an image of the powder using the CCD camera, calculating the precise position of the powder on the basis of the captured image, and then removing the powder using the laser apparatus.

According to this apparatus, the foreign matter can be removed by detecting the precise position of the foreign matter automatically. However, the apparatus described in JP 2001-41904 A is not an apparatus used to detect foreign matter on the surface of a rotating rotary roller and remove the detected foreign matter.

SUMMARY OF THE INVENTION

The invention provides a rotary roller surface cleaning method and a rotary roller surface cleaning apparatus, with which foreign matter on the surface of a rotating rotary roller can be detected and when foreign matter is detected, the detected foreign matter can be removed before reaching a position below a molten metal discharge port without stopping the rotary roller during a process for manufacturing a quenched ribbon by supplying a molten metal constituted by a rare earth magnet material to the rotary roller and quenching the molten metal.

An first aspect of the invention relates to a rotary roller surface cleaning method for a quenched ribbon manufacturing apparatus including: a furnace that contains a molten metal constituted by a rare earth magnet material; and a rotary roller that is supplied with the molten metal from the furnace during rotation and quenches the supplied molten metal to manufacture a quenched ribbon for a rare earth magnet. The method includes: emitting a laser onto a surface of the rotary roller; receiving a reflection laser obtained when the laser emitted onto the surface of the rotary roller is reflected; measuring an intensity of the reflection laser;

detecting foreign matter on the surface of the rotary roller on the basis of the intensity of the reflection laser; when the foreign matter is detected, controlling an output of an emission laser to be emitted to have an output value corresponding to a thickness of the foreign matter; removing the foreign matter by irradiating the foreign matter with a controlled laser to clean the surface of the rotary roller; and adjusting at least one of a rotation speed of the rotary roller and a laser response time, which is a time required to control the output of the emission laser to have the output value corresponding to the thickness of the foreign matter after receiving the reflection laser, such that the rotation speed of the rotary roller and the laser response time satisfy a relational expression $V \times S \leq D/1000$ ($D \geq 0.1$ mm), where the rotation speed of the rotary roller is V (m/sec), the laser response time is S (sec), and a length of the foreign matter along a circumferential direction of the rotary roller is D (mm).

According to the first aspect, foreign matter is detected from the intensity of the reflection laser obtained when the laser emitted onto the surface of the rotary roller is reflected. When foreign matter is detected, the output value of a laser to be emitted is controlled in accordance with the thickness of the foreign matter, on the basis of the fact that the output value required to remove the foreign matter differs according to the thickness thereof, whereupon the foreign matter is removed by irradiating the foreign matter with the controlled laser. As a result, the surface of the rotary roller is cleaned. Further, at least one of the rotation speed V of the rotary roller and the laser response time S are adjusted such that the rotation speed of the rotary roller and the laser response time satisfy $V \times S \leq D/1000$ (where D indicates the length of the foreign matter in the circumferential direction of the rotary roller, and has a condition of $D \geq 0.1$ mm). According to this method, when foreign matter adhered to the rotary roller is detected, the detected foreign matter can be removed before reaching a position below the molten metal discharge port, and as a result, a high-quality quenched ribbon can be manufactured efficiently.

A second aspect of the invention relates to a rotary roller surface cleaning apparatus for a quenched ribbon manufacturing apparatus including: a furnace that contains a molten metal constituted by a rare earth magnet material; and a rotary roller that is supplied with the molten metal from the furnace during rotation and quenches the supplied molten metal to manufacture a quenched ribbon for a rare earth magnet. The apparatus includes: a laser oscillator that emits a laser onto a surface of the rotary roller; a detector that receives a reflection laser obtained when the laser emitted onto the surface of the rotary roller is reflected, measures an intensity of the reflection laser, and detects foreign matter on the surface of the rotary roller on the basis of the intensity of the reflection laser; a laser output value control unit configured to, when the foreign matter is detected by the detector, control an output of an emission laser to be emitted to have an output value corresponding to a thickness of the foreign matter, and removes the foreign matter by irradiating the foreign matter with a controlled laser to clean the surface of the rotary roller; and a speed control unit configured to control at least one of a rotation speed of the rotary roller and a laser response time, which is a time required to control the output of the emission laser to have the output value corresponding to the thickness of the foreign matter after receiving the reflection laser, such that the rotation speed of the rotary roller and the laser response time satisfies a relational expression $V \times S \leq D/1000$ ($D \geq 0.1$ mm), where the rotation speed of the rotary roller is V (m/sec), the laser response time is S (sec), and a length of the foreign matter in a circumferential direction of the rotary roller is D (mm).

According to the second aspect of the invention, similarly to the first aspect, when foreign matter adhered to the rotary roller is detected, the detected foreign matter can be removed before reaching a position below the molten metal discharge port, and as a result, a high-quality quenched ribbon can be manufactured efficiently.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

An embodiment of a rotary roller surface cleaning method and a rotary roller surface cleaning apparatus for detecting foreign matter on a rotary roller surface and cleaning the rotary roller surface according to the invention will be described below with reference to the drawings.

Figure 1:
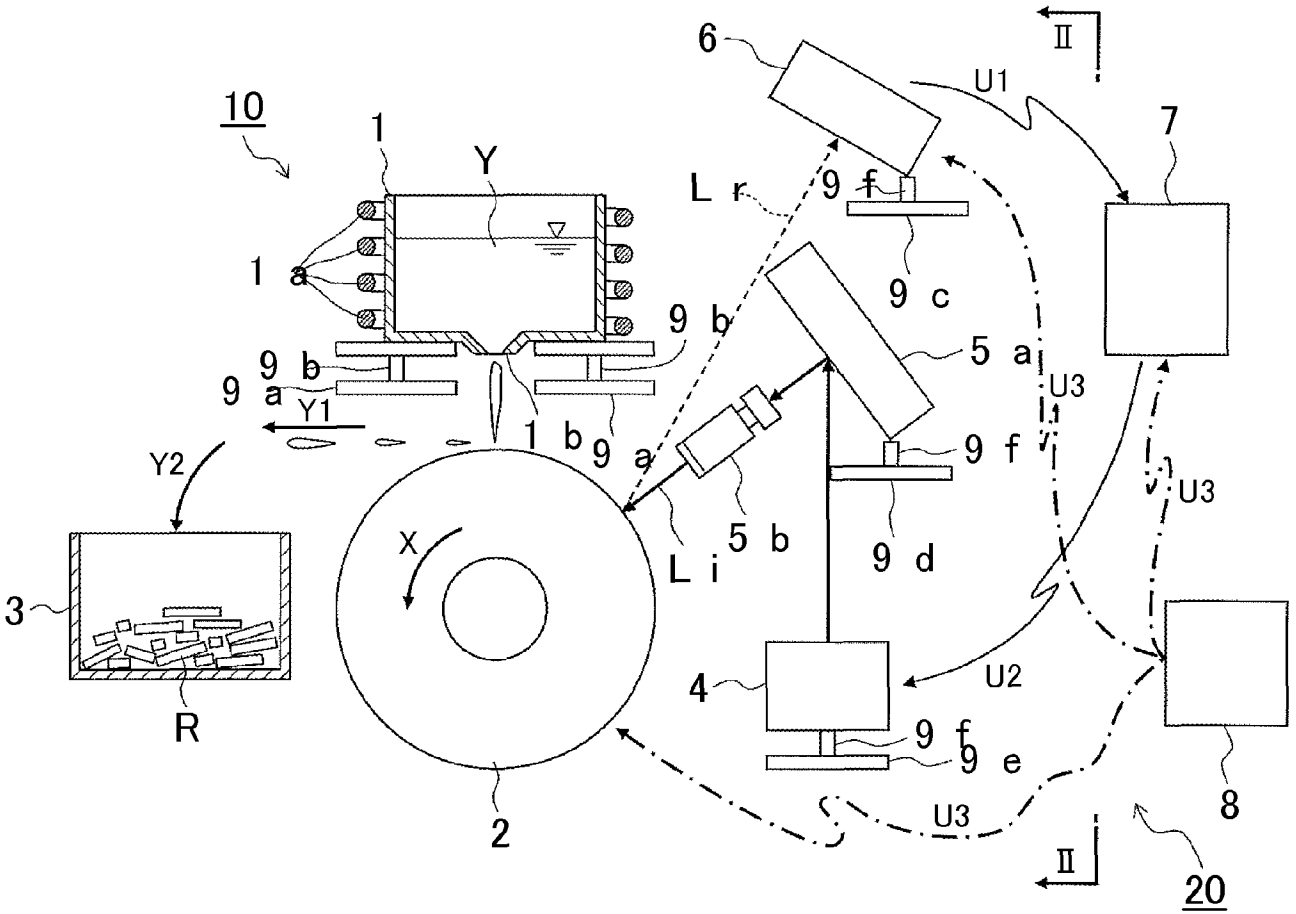
FIG. 1 is a schematic diagram showing a rotary roller surface cleaning apparatus according to the invention, together with a quenched ribbon manufacturing apparatus.
Figure 3A:
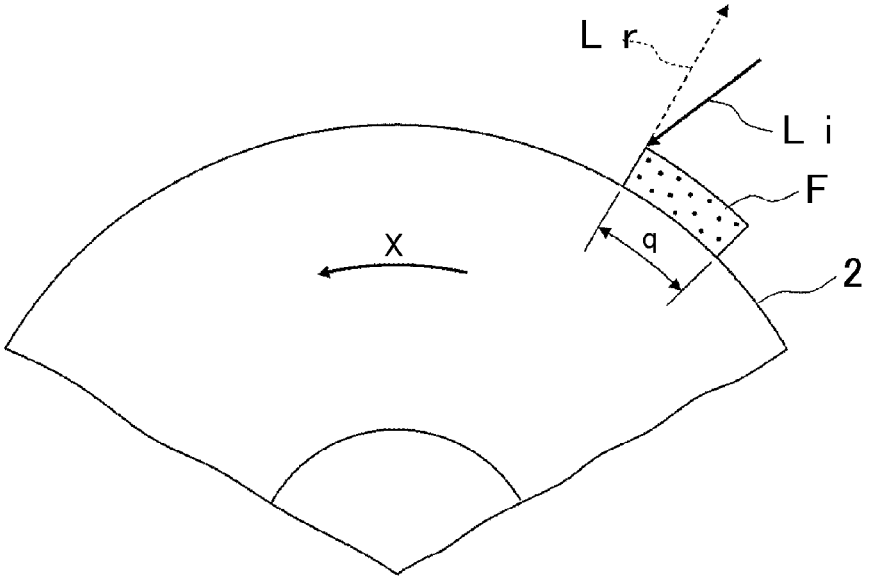
FIG. 3A is a view illustrating a condition in which a reflection laser is obtained from a laser emitted onto foreign matter adhered to a surface of a rotary roller.
Figure 3B:
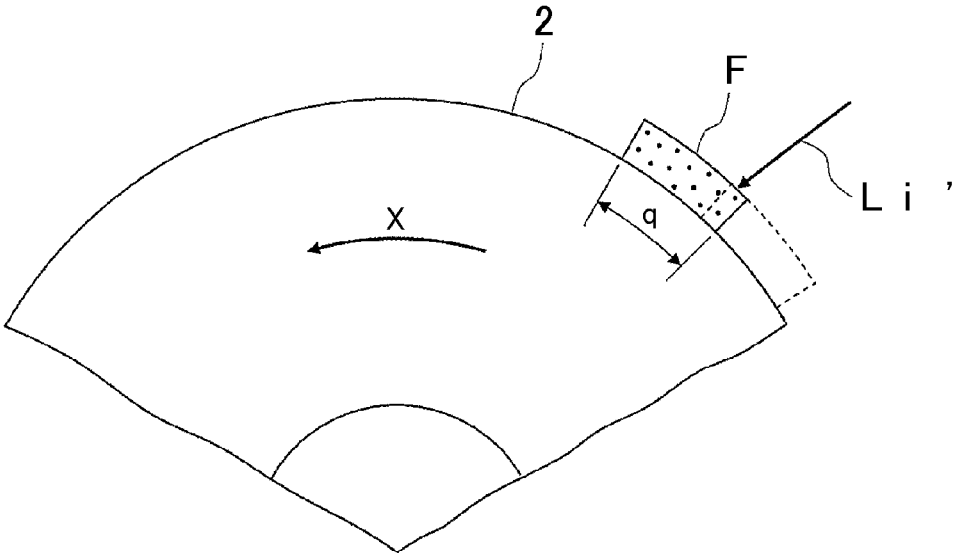
FIG. 3B is a view illustrating a condition in which the foreign matter is irradiated with a laser having an adjusted output value.
Figure 4:
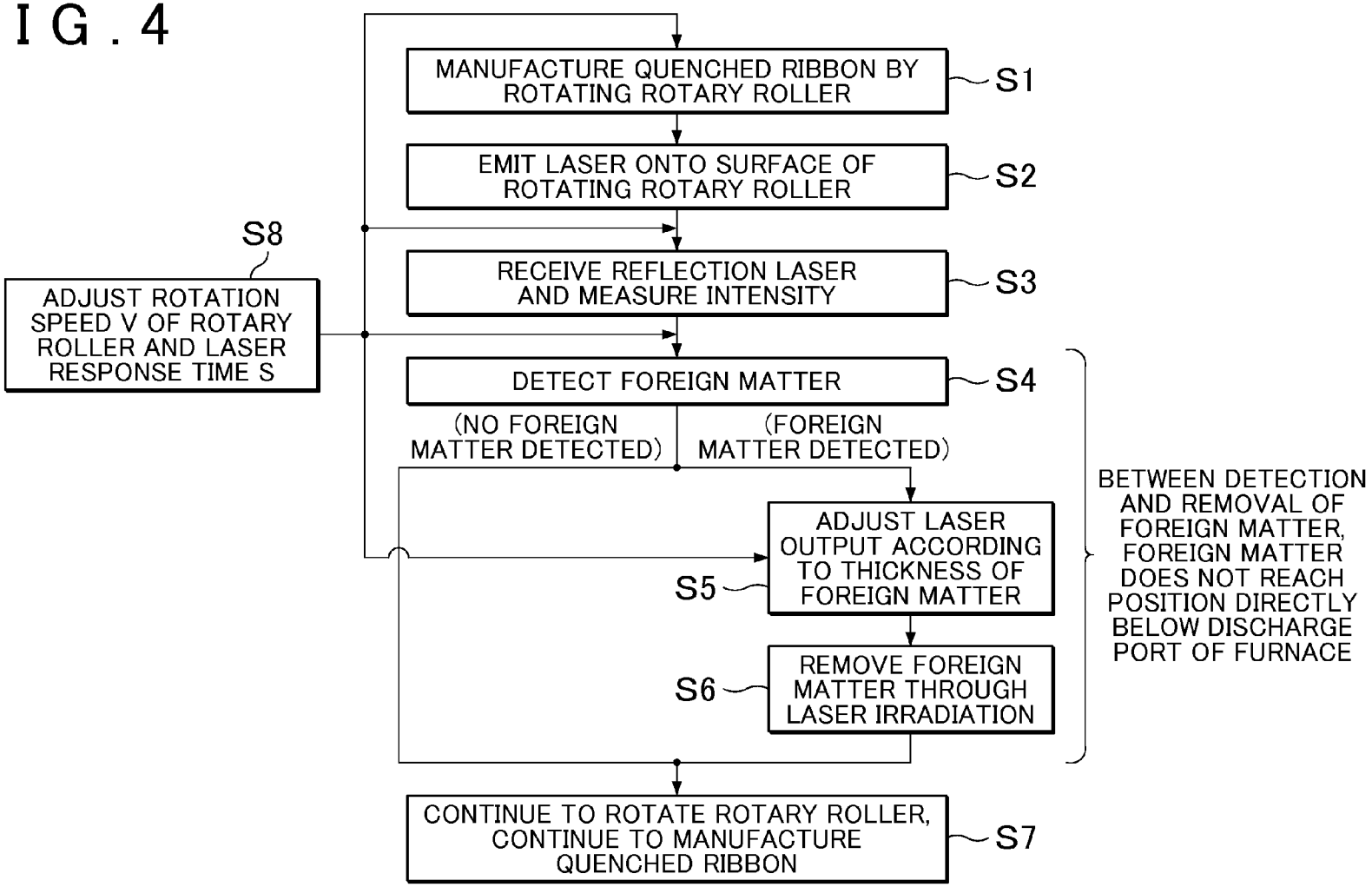
FIG. 4 is a flowchart illustrating a rotary roller surface cleaning method.

FIG. 1 is a schematic diagram showing the rotary roller surface cleaning apparatus according to the invention, together with a quenched ribbon manufacturing apparatus, and FIG. 2 is a view taken along an arrow II-II in FIG. 1. Further, FIG. 3A is a view illustrating a condition in which a reflection laser is obtained from a laser emitted onto foreign matter adhered to a surface of a rotary roller, and FIG. 3B is a view illustrating a condition in which the foreign matter is irradiated with a laser having an adjusted output value. Furthermore, FIG. 4 is a flowchart illustrating a rotary roller surface cleaning method.

In FIG. 1, a rotary roller surface cleaning apparatus 20 is disposed on the side of a quenched ribbon manufacturing apparatus 10. The manufacturing apparatus 10 includes a furnace 1 having a high-frequency coil 1*a* on a periphery thereof, a rotary roller 2 disposed below a discharge port 1*b* opened in the bottom of the furnace 1, and a collection box 3 disposed on the side of the rotary roller 2.

The interior of the furnace 1 can be controlled to a reduced-pressure Ar gas atmosphere of no more than 50 kPa, for example. Manufacture is performed using a melt spinning method. In the furnace 1, alloy ingots are melted at high frequency by operating the high-frequency coil 1*a*, whereupon a molten metal Y constituted by a rare earth magnet material drips down onto the rotary roller 2, which is made of copper.

Here, the quenched ribbon is constituted by an RE-Fe—B main phase (where RE is at least one of Nd and Pr), and an RE-X alloy (where X is a metallic element not containing a heavy rare earth element) surrounding the main phase. In the case of a nano-crystalline structure, for example, the main phase is constituted by crystal grains having a diameter of approximately 50 to 200 nm.

Further, the Nd—X alloy constituting the grain boundary phase is an alloy of Nd and at least one of Co, Fe, Ga, Cu, Al, and so on. For example, the Nd—X alloy is one of Nd—Co, Nd—Fe, Nd—Ga, Nd—Co—Fe, or Nd—Co—Fe—Ga or a mixture of two or more of these alloys, whereby an Nd rich condition is obtained.

The molten metal Y that drips onto an apex of the rotary roller 2 is quenched upon contact with the rotary roller 2 as the rotary roller 2 rotates in an X direction, and then ejected in a tangential direction to the apex of the rotary roller 2 (a Y1 direction). While falling (in a Y2 direction), the quenched molten metal Y forms a quenched ribbon R having a crystalline structure, which falls into and is collected in the collection box 3.

The foreign matter detection and cleaning apparatus 20, meanwhile, is configured as follows. First, the foreign matter detection and cleaning apparatus 20 includes a laser oscillator 4 that emits a pico-wave laser, and a detector 6 that receives a reflection laser Lr obtained when a laser Li emitted onto the surface of the rotary roller 2 via a reflection mirror 5*a* that reflects the emitted laser and a condenser lens 5*b* that condenses the laser reflected by the reflection mirror 5*a* is reflected by the surface of the rotary roller 2, measures an intensity of the reflection laser Lr, and detects foreign matter (determines the presence of foreign matter) on the basis of the intensity of the reflection laser Lr. Note that an oscillator that emits a laser having a shorter wavelength than a pico-wave laser (a femto-wave laser or the like) may be used as the applied laser oscillator instead of a pico-wave laser oscillator.

In an embodiment of the detector 6, the detector 6 stores data indicating an energy peak value of a reflection laser obtained when no foreign matter exists, the energy peak value of a reflection laser obtained when foreign matter exists, and energy peak values of reflection lasers corresponding to respective thicknesses of existing foreign matter. The detector 6 can then determine the presence of foreign matter and the thickness of the foreign matter instantaneously upon reception of the reflection laser by identifying the energy peak value of the received reflection laser and comparing the identified energy peak value with the stored data.

In another embodiment of the detector 6, the thickness of the foreign matter can be calculated instantaneously using a trigonometric equation built into the detector 6 on the basis of respective angles of the laser entering the surface of the rotary roller 2 and the reflection laser reflected thereby.

The rotary roller surface cleaning apparatus 20 further includes a laser output value control unit 7 which, when foreign matter is detected by the detector 6, controls an output of a emission laser to be emitted to have a laser output value corresponding to the thickness of the foreign matter and causes the laser oscillator 4 to emit the controlled laser. More specifically, data relating to the presence of foreign matter and, when foreign matter exists, a data signal indicating the energy peak value or the thickness of the foreign matter (a signal U1 in FIG. 1) are transmitted from the detector 6 to the laser output value control unit 7.

Data indicating laser output values corresponding to the energy required to remove (sublimate) foreign matter of respective thicknesses are stored in the laser output value control unit 7 in advance. The laser output value required to remove the foreign matter is then identified in accordance with the foreign matter thickness transmitted from the detector 6, whereupon a control signal (a signal U2 in FIG. 1) for irradiating the foreign matter with a laser having an appropriately increased energy is transmitted to the laser oscillator 4.

The rotary roller surface cleaning apparatus 20 further includes a speed control unit 8 that controls at least one of a rotation speed V and a laser response time S such that the rotation speed V and the laser response time S satisfy a relational expression $V \times S \leq D/1000$ ($D \geq 0.1$ mm), where the rotation speed of the rotary roller 2 is V (m/sec), the laser response time is S (sec), and a length of foreign matter F along a circumferential direction (a rotation direction) of the rotary roller 2 is D (mm). Here, the laser response time S is a time required to receive the reflection laser Lr, measure the intensity of the reflection laser Lr, and control the output of the emission laser. The inventors found that agglutinated material constituting the foreign matter has a circumferential direction length of approximately 0.1 to 5 mm, and that the thickness of the agglutinated material constituting the foreign matter is approximately several μm at a maximum, and approximately 2 to 3 μm on average.

By controlling the rotation speed of the rotary roller 2 and/or controlling the laser response time using the speed control unit 8, the foreign matter detected by the detector 6 can be irradiated with a laser having an output value controlled in accordance with the thickness of the foreign matter immediately, or in other words before the detected foreign matter passes a laser emission position (a laser emittable range).

During the control performed by the speed control unit 8, the speed control unit 8 transmits a control signal (a signal U3 in FIG. 1) relating to the rotation speed V and the laser response time S required to satisfy the relational expression $V \times S \leq D/1000$ ($D \geq 0.1$ mm) to the detector 6, the laser output value control unit 7, and the rotary roller 2 (an actuator, not shown in the drawings, that drives the rotary roller 2 to rotate).

Note that the detector 6, the laser output value control unit 7, and the speed control unit 8 constituting the rotary roller surface cleaning apparatus 20 may be built into a single computer together with a CPU, not shown in the drawings, and connected to each other by a bus or the like to be capable of exchanging data, or may be built respectively into separate computers and operated by dedicated CPUs so as to exchange data either wirelessly or over a wire.

With the manufacturing apparatus 10 alongside which the rotary roller surface cleaning apparatus 20 shown in the drawings is disposed, when the existence of foreign matter is determined, the foreign matter can be irradiated and removed by a laser having enough energy to sublimate the foreign matter, and as a result, the surface of the rotary roller 2 can be cleaned. Moreover, after the foreign matter is detected, removal of the detected foreign matter is executed before the foreign matter returns to a position below the discharge port 1*b* of the furnace 1. Hence, the foreign matter can be removed from the surface of the rotary roller 2 reliably while continuing to rotate the rotary roller 2, or in other words without the need to perform an operation to halt rotation of the rotary roller 2 temporarily in order to remove the foreign matter. As a result, a high-quality quenched ribbon can be manufactured efficiently.

Figure 2A:
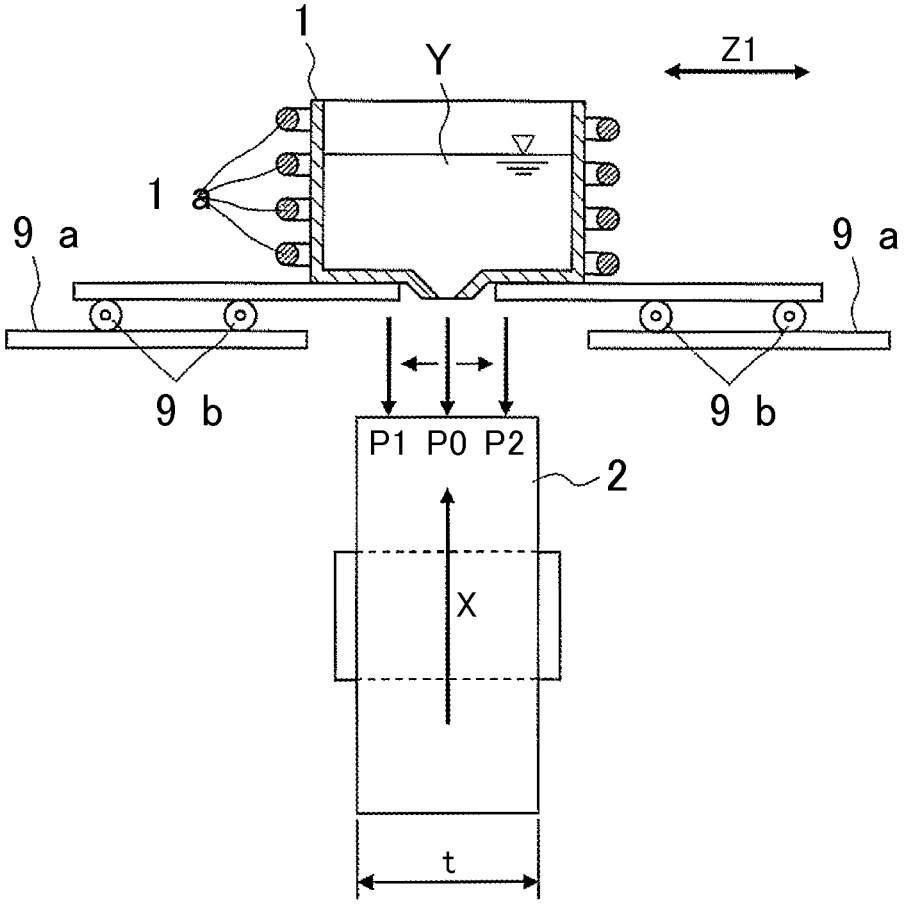
FIGS. 2A to 2D are views taken along an arrow II-II in FIG. 1.

Further, as shown in FIG. 2A, wheels 9*b* are provided below the furnace 1 constituting the manufacturing apparatus 10, enabling the furnace 1 to slide along a movable carriage 9*a* in a width direction of the rotary roller 2 (a Z1 direction).

When the molten metal Y is actually supplied onto the surface of the rotary roller 2, control is preferably performed to cause the furnace 1 to slide from a central position P0 in the width direction of the rotary roller 2, which has a width t, to another position such as left and right positions P1, P2. In so doing, the supplied molten metal Y is prevented from concentrating in a specific location on the surface of the rotary roller 2.

Figure 2B:
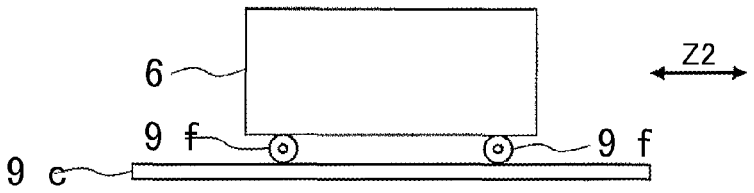
Figure 2C:
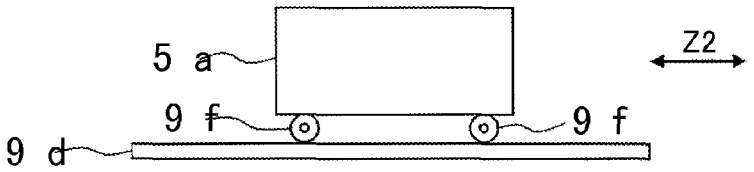
Figure 2D:
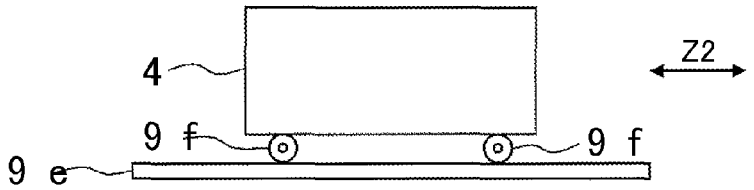

As shown in FIGS. 2B to 2D, in accordance with this configuration, the detector 6 that detects foreign matter by receiving the reflection laser, the laser output value control unit 7 that controls the output of the emission laser in accordance with the thickness of the detected foreign matter, and the laser oscillator 4 that emits the controlled laser are respectively provided with wheels 9*f* so as to be capable of moving along movable carriages 9*c*, 9*d*, 9*e*, respectively, in an identical direction to and in synchronization with the movement of the furnace 1.

Next, referring to FIGS. 3A and 3B, a manner in which foreign matter adhered to the surface of the rotary roller 2 can be removed by a laser more reliably through vaporization using control performed by the speed control unit 8 will be described.

As shown in FIG. 3A, it is assumed that foreign matter F having a length q along the circumferential direction of the rotary roller 2 exists on the surface of the rotary roller 2.

After the laser Li has been emitted onto an end portion of the foreign matter F, the reflection laser Lr reaches the detector 6, whereby the existence and the thickness of the foreign matter F are determined.

In the speed control unit 8, at least one of the rotation speed V of the rotary roller 2 and the laser response time S is controlled such that the rotation speed V of the rotary roller 2 and the laser response time S satisfy the relational expression $V \times S \leq D/1000$ ($D \geq 0.1$ mm). For example, the length D of the foreign matter F adhered to the surface of the rotary roller 2 is set at 0.1 mm, and therefore at least one of the rotation speed V of the rotary roller 2 and the laser response time S are adjusted to satisfy $V \times S \leq 0.1 \times 10^{-3}$.

When the rotation speed of the rotary roller 2 is constant, for example, a laser Li' having an output value controlled in accordance with the thickness of the foreign matter F is emitted more reliably onto the foreign matter F moving from the condition shown in FIG. 3A within the laser response time S satisfying the above relational expression.

Next, referring to FIG. 4, a series of operations performed by the rotary roller surface cleaning apparatus described above, or in other words a rotary roller surface cleaning method, will be summarized.

In the rotary roller surface cleaning method shown in the drawings, foreign matter on the surface of the rotary roller is removed while continuing to rotate the rotary roller and continuing to manufacture the quenched ribbon, and without affecting the quality of the manufactured quenched ribbon. The method involves detecting foreign matter on the surface of the rotary roller, and following detection, irradiating the foreign matter with a laser corresponding to the thickness of the foreign matter instantaneously before the foreign matter passes the laser emission position in order to sublime (vaporize) the foreign matter.

First, the rotary roller is rotated by switching the actuator that drives the rotary roller ON. Accordingly, the molten metal drips down from the furnace and is quenched by the rotary roller, whereby the quenched ribbon is manufactured (step S1).

A desired site on the surface of the rotary roller is continuously irradiated with the pico-wave laser (step S2). Note that the furnace is controlled to slide to the left and right periodically from the width direction central position of the rotary roller, and by sliding the furnace in this manner, the entire surface of the rotary roller can be used effectively. As a result, a situation in which the temperature on the surface of the rotary roller is raised by the molten metal and damage occurs in a single location on the surface of the rotary roller can be avoided.

The reflection laser obtained by reflection of the pico-wave laser emitted onto the surface of the rotary roller is then received, and the intensity (energy) of the reflection laser is measured (step S3).

Foreign matter is detected (the existence of foreign matter is determined) in accordance with the intensity of the reflection laser (step S4).

When foreign matter is not detected (when foreign matter is determined to be absent), no further measures are required, and therefore rotation of the rotary roller and manufacture of the quenched ribbon are continued (step S7).

When foreign matter is detected (when foreign matter is determined to be present), on the other hand, the laser output value is adjusted in accordance with the thickness of the foreign matter (step S5).

By irradiating the foreign matter with a laser having the adjusted laser output value, the foreign matter is removed from the surface of the rotary roller (step S6).

Here, throughout steps S1 to S5, at least one of the rotation speed V of the rotary roller and the laser response time S are adjusted appropriately such that the rotation speed V of the rotary roller and the laser response time S are maintained to satisfy the relational expression $V \times S \leq D/1000$ ($D \geq 0.1$ mm) (step S8).

As a result of the adjustment performed in step S8, the foreign matter detected on the surface of the rotary roller is removed by laser irradiation before the detected foreign matter reaches a position directly below the discharge port of the furnace. Accordingly, quenching of the molten metal supplied from the furnace is not obstructed by the foreign matter, and as a result, a quenched ribbon exhibiting superior quality can be manufactured. Moreover, since there is no need to halt the rotation of the rotary roller during the processing flow, the quenched ribbon can be manufactured continuously from the supplied molten metal.

Figure 5:
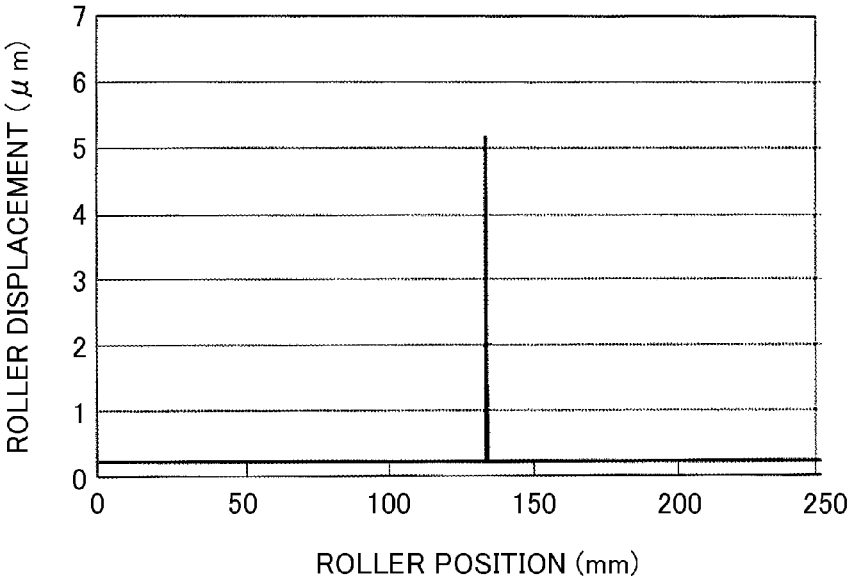
FIG. 5 is a view showing experiment results obtained in relation to a roller position in a width direction and roller displacement (a thickness of the foreign matter) on the surface of the rotary roller.

The inventors measured foreign matter constituted by agglutinated material in the detector using trigonometry. It can be determined that sites of the roller in which displacement occurs correspond to the thickness of the foreign matter. FIG. 5 shows experiment results relating to a roller position in the width direction and roller displacement (the thickness of the foreign matter).

As shown in the drawing, in this experiment, roller displacement of approximately 5 μm was calculated in a position (substantially the width direction central position) approximately 130 mm from a left end of a rotary roller having a width of 250 mm.

The inventors found that the average thickness of the foreign matter is approximately 2 to 3 μm, but in this experiment, the adhered foreign matter had a greater thickness than the average value.

By applying trigonometry in the detector in this manner, the thickness of the foreign matter can be calculated with a high degree of precision.

Figure 6A:
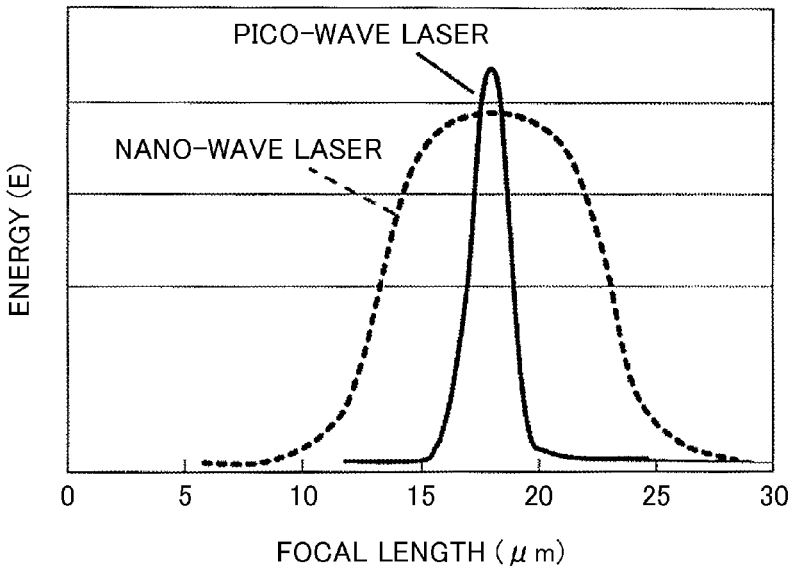
FIG. 6A is a view illustrating a relationship between focal length and energy in a nano-wave laser and a pico-wave laser.

The inventors conducted an experiment to determine a relationship between focal distance and energy in a nano-wave laser and a pico-wave laser. Results of the experiment are shown in FIG. 6A.

As is evident from the drawing, the nano-wave laser has a wide focal length of approximately 15 μm, whereas the pico-wave laser has a narrow focal length of approximately 4 μm.

Figure 6B:
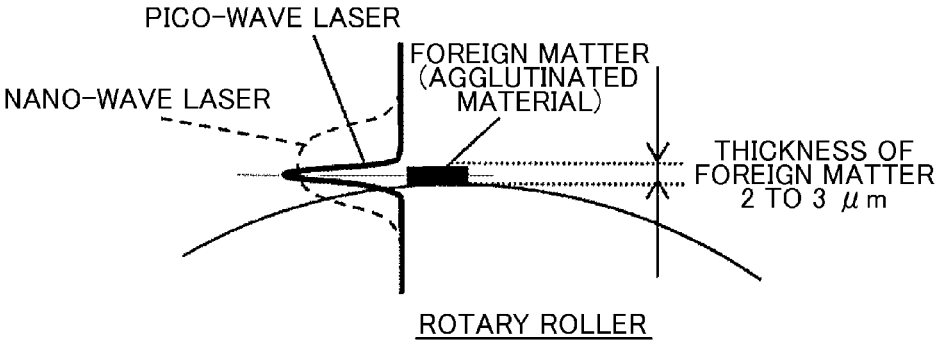
FIG. 6B is a view showing respective energy distributions of the nano-wave laser and the pico-wave laser in relation to foreign matter on the surface of the rotary roller.

Next, a relationship between the thickness of the foreign matter on the surface of the rotary roller and the utility of the two types of lasers was investigated on the basis of respective energy distributions of the lasers. Results of the experiment are shown in FIG. 6B.

As described above, the average thickness of the foreign matter is approximately 2 to 3 μm. When the foreign matter is irradiated with a pico-wave laser having a focal depth of approximately 4 μm, an effect of the pico-wave laser does not extend to the surface of the rotary roller beneath the foreign matter and a deeper range beneath the surface. Therefore, when the foreign matter is irradiated with a pico-wave laser, the rotary roller is not damaged by the pico-wave laser.

When the foreign matter is irradiated with a nano-wave laser having a deeper focal depth of approximately 15 μm, on the other hand, the effect of the nano-wave laser extends to the surface of the rotary roller beneath the foreign matter and a deeper range beneath the surface. Therefore, when the foreign matter is irradiated with a nano-wave laser, the rotary roller may be damaged by the nano-wave laser.

In consideration of these investigation results, a pico-wave laser or a laser having a shorter wavelength than a pico-wave laser is preferably used in the rotary roller surface cleaning method and the rotary roller surface cleaning apparatus according to the invention.

Figure 7A:
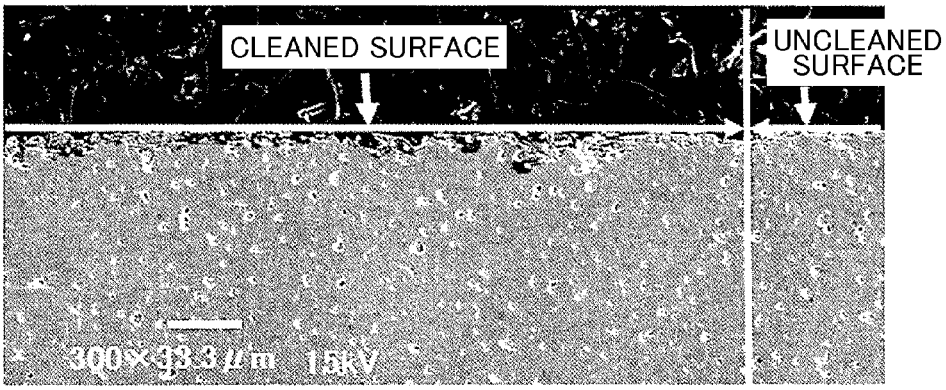
FIGS. 7A and 7B are SEM images showing the surface of the rotary roller in a cleaned condition and an uncleaned condition.
Figure 7B:
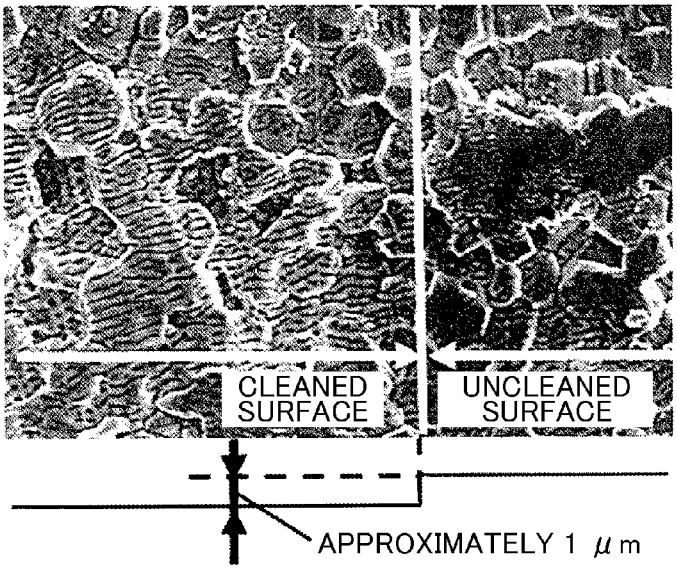

The inventors formed a site cleaned by laser irradiation and an uncleaned site including residual agglutinated material on the surface of the rotary roller, captured SEM images of the respective sites, and compared the images through observation. Here, the Talisker Ultra model manufactured by Coherent Inc. was used as the laser oscillator applied to the cleaning operation, and a laser was emitted for 15 picoseconds at a repetition frequency of 200 kHz, an average laser output of 16 W, and a laser advancement speed of 3000 mm/sec. FIGS. 7A and 7B respectively show SEM images of the surface of the rotary roller in a cleaned condition and an uncleaned condition.

It is evident from FIG. 7A that a step of approximately 1 μm is formed on the uncleaned surface. Further, it can be confirmed from FIG. 7B that the agglutinated material has been sublimated by laser irradiation so that a streaky pattern is formed on the cleaned surface.

In the relational expression according to the invention, the laser response time S is the time required to detect foreign matter constituted by agglutinated material and control the output value of the laser in accordance with the thickness thereof.

For example, when the rotation speed of the rotary roller is set within a range of 20 to 40 m/sec and the laser response time is set within a range of one nanosecond to one millisecond, a distance by which the agglutinated material moves in the rotation direction over the laser response time as the rotary roller rotates is between 0.02 μm and 40 mm.

The inventors found that the circumferential direction length of the agglutinated material is typically between 0.1 mm and 5 mm. Hence, by adjusting the rotation speed of the rotary roller and the laser response time appropriately, enough time remains following detection of the agglutinated material to remove the agglutinated material by irradiating the agglutinated material with a laser having a controlled output value.

For this purpose, V and S should be adjusted appropriately in order to satisfy the relational expression $V \times S \leq D/1000$ ($D \geq 0.1$ mm), where the rotation speed of the rotary roller is V (m/sec), the laser response time is S (sec), and the length of the foreign matter in the rotation direction of the rotary roller is D (mm).

Figure 8:
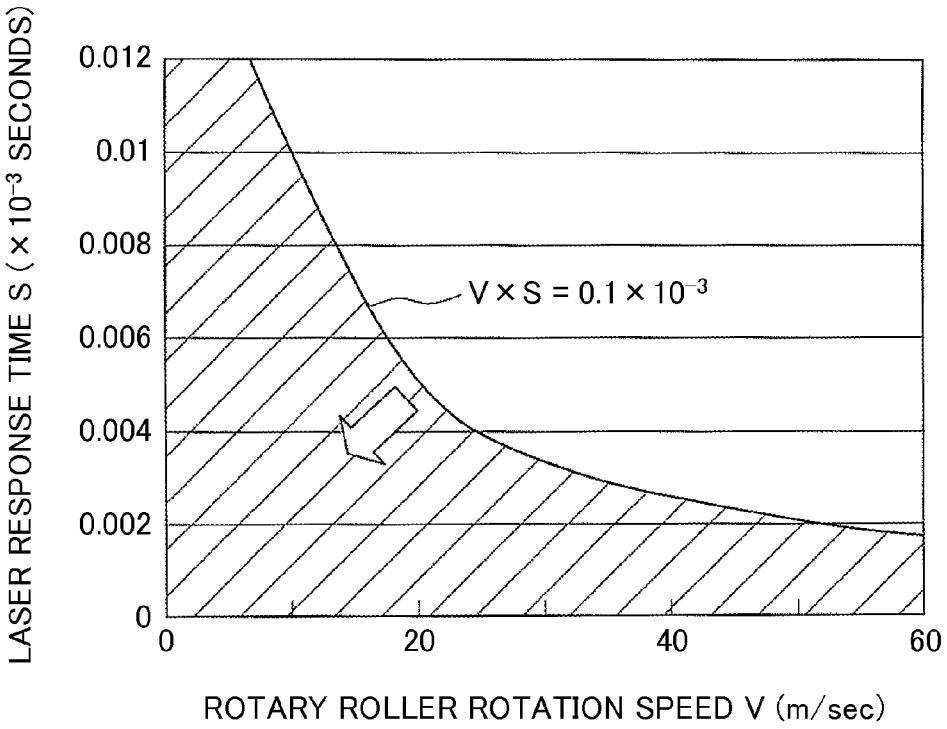
FIG. 8 is a view showing a relational expression between a rotation speed V of the rotary roller and a laser response time S.

Here, a relationship shown in FIG. 8 between the rotation speed V of the rotary roller and the laser response time S corresponds to the relational expression $V \times S \leq 0.1 \times 10^{-3}$ obtained when the circumferential direction length of the agglutinated material is set at 0.1 mm and laser irradiation is performed under the strictest conditions (a shaded portion of the drawing corresponds to a region in which $V \times S \leq 0.1 \times 10^{-3}$).

By adjusting the rotation speed V of the rotary roller and the laser response time S to be included within the range of the shaded portion in the drawing, agglutinated material having a circumferential direction length of 0.1 mm can be irradiated and removed more reliably with a pico-wave laser having an output value controlled in accordance with the thickness of the agglutinated material.

An embodiment of the invention was described in detail above using the drawings, but the invention is not limited to the specific configurations of this embodiment, and includes design modifications and the like implemented within a range that does not depart from the spirit of the invention. [US Only]

As detailed above, an first aspect of the invention relates to a rotary roller surface cleaning method for a quenched ribbon manufacturing apparatus including: a furnace that contains a molten metal constituted by a rare earth magnet material; and a rotary roller that is supplied with the molten metal from the furnace during rotation and quenches the supplied molten metal to manufacture a quenched ribbon for a rare earth magnet. The method includes: emitting a laser onto a surface of the rotary roller; receiving a reflection laser obtained when the laser emitted onto the surface of the rotary roller is reflected; measuring an intensity of the reflection laser; detecting foreign matter on the surface of the rotary roller on the basis of the intensity of the reflection laser; when the foreign matter is detected, controlling an output of an emission laser to be emitted to have an output value corresponding to a thickness of the foreign matter; removing the foreign matter by irradiating the foreign matter with a controlled laser to clean the surface of the rotary roller; and adjusting at least one of a rotation speed of the rotary roller and a laser response time, which is a time required to control the output of the emission laser to have the output value corresponding to the thickness of the foreign matter after receiving the reflection laser, such that the rotation speed of the rotary roller and the laser response time satisfy a relational expression $V \times S \leq D/1000$ ($D \geq 0.1$ mm), where the rotation speed of the rotary roller is V (m/sec), the laser response time is S (sec), and a length of the foreign matter along a circumferential direction of the rotary roller is D (mm).

According to the first aspect, foreign matter is detected from the intensity of the reflection laser obtained when the laser emitted onto the surface of the rotary roller is reflected. When foreign matter is detected, the output value of a laser to be emitted is controlled in accordance with the thickness of the foreign matter, on the basis of the fact that the output value required to remove the foreign matter differs according to the thickness thereof, whereupon the foreign matter is removed by irradiating the foreign matter with the controlled laser. As a result, the surface of the rotary roller is cleaned. Further, at least one of the rotation speed V of the rotary roller and the laser response time S are adjusted such that the rotation speed of the rotary roller and the laser response time satisfy $V \times S \leq D/1000$ (where D indicates the length of the foreign matter in the circumferential direction of the rotary roller, and has a condition of $D \geq 0.1$ mm). According to this method, when foreign matter adhered to the rotary roller is detected, the detected foreign matter can be removed before reaching a position below the molten metal discharge port, and as a result, a high-quality quenched ribbon can be manufactured efficiently.

The inventors found that agglutinated material constituting the foreign matter has a circumferential direction length of approximately 0.1 to 5 mm, and the thickness of the agglutinated material constituting the foreign matter is approximately several μm at the maximum, and approximately 2 to 3 μm on average. Here, by adjusting at least one of the rotation speed V (m/sec) of the rotary roller and the laser response time S (sec) (the time required to receive the reflection laser, measure the intensity of the reflection laser, and control the output of the laser to be emitted) such that the rotation speed V of the rotary roller and the laser response time S satisfy the relational expression $V \times S \leq D/1000$ ($D \geq 0.1$ mm), the foreign matter can be irradiated more reliably with a laser having an increased output value.

Comparing foreign matter having a length of 0.1 mm and foreign matter having a length of 5 mm, for example, when the rotation speed of the rotary roller remains constant, a response speed (a laser response time) that is 50 times higher than a response speed required when emitting a laser onto the foreign matter having a length of 5 mm is required to emit a laser onto the foreign matter having a length of 0.1 mm. In the method according to the invention, the rotation speed of the rotary roller may be adjusted alone, the response speed (the laser response time) may be adjusted alone, or both the rotation speed and the response speed may be adjusted. By adjusting both the rotation speed and the response speed, however, a situation in which one thereof becomes excessively high can be avoided.

In the first aspect, removal of the foreign matter following detection of the foreign matter may be performed before the foreign matter reaches a position in which the molten metal is supplied onto the rotary roller. Further, in the first aspect, the at least one of the rotation speed of the rotary roller and the laser response time may be adjusted such that the rotation speed of the rotary roller and the laser response time are maintained to satisfy the relational expression $V \times S \leq D/1000$ ($D \geq 0.1$ mm) after detection of the foreign matter until removal of the foreign matter.

In the first aspect, the thickness of the foreign matter may be calculated on the basis of the reflection laser and the output of the emission laser may be controlled in accordance with the calculated thickness of the foreign matter, or the thickness of the foreign matter may be determined in accordance with an energy of the reflection laser and the output of the emission laser may be controlled in accordance with the determined thickness of the foreign matter.

An energy value (an energy peak value) of the detected reflection laser differs according to the presence and the thickness of foreign matter. Hence, by predefining the energy value of a reflection laser obtained when no foreign matter exists and energy values corresponding to respective thicknesses of existing foreign matter, the presence of foreign matter, and in a case where foreign matter exists the thickness thereof, can be determined instantaneously from the energy peak value of the reflection laser.

Further, in a case where the thickness of the foreign matter is calculated using a computer or the like, a calculation unit configured to perform calculations using trigonometry may be built into the computer, for example, and the thickness of the foreign matter may be calculated using trigonometry on the basis of an angle formed by the laser that enters the foreign matter and an angle formed by the reflection laser.

Output values (laser energy values) required to remove foreign matter of respective thicknesses may be defined in advance in the computer. The output value required to remove the foreign matter can then be determined in accordance with the calculated thickness of the foreign matter or the foreign matter thickness determined from the energy of the reflection laser. Then, when foreign matter removal is required, the foreign matter can be irradiated with a laser having an increased output value.

In the first aspect, the laser may be a pico-wave laser or a laser having a shorter wavelength than the pico-wave laser.

A pico-wave laser or a laser (a femto-wave laser or the like, for example) having a shorter wavelength than the pico-wave laser has a shallow focal depth, making it possible to sublimate (or vaporize) only foreign matter having a thickness of approximately several μm adhered to the surface of the rotary roller. On the other hand, a nano-wave laser or the like, for example, has a deep focal depth, and therefore an effect of the laser extends not only the foreign matter but also the interior of the rotary roller beneath the foreign matter. As a result, the surface of the rotary roller may be damaged.

The discharge port of the furnace that supplies the molten metal onto the rotary roller may be movable in a width direction of the rotary roller directly above the rotary roller. In so doing, a situation in which the molten metal is supplied only to a fixed location on the surface of the rotary roller can be avoided. When the molten metal is supplied only to a fixed location, a quenching effect of the molten metal decreases, and the fixed location on the surface of the rotary roller is more likely to be damaged.

When the discharge port of the furnace is movable in the width direction of the rotary roller in this manner, an emission position of the laser may be varied in an identical direction to the movement direction of the discharge port in synchronization with the movement of the discharge port.

A second aspect of the invention relates to a rotary roller surface cleaning apparatus for a quenched ribbon manufacturing apparatus including: a furnace that contains a molten metal constituted by a rare earth magnet material; and a rotary roller that is supplied with the molten metal from the furnace during rotation and quenches the supplied molten metal to manufacture a quenched ribbon for a rare earth magnet. The apparatus includes: a laser oscillator that emits a laser onto a surface of the rotary roller; a detector that receives a reflection laser obtained when the laser emitted onto the surface of the rotary roller is reflected, measures an intensity of the reflection laser, and detects foreign matter on the surface of the rotary roller on the basis of the intensity of the reflection laser; a laser output value control unit configured to, when the foreign matter is detected by the detector, control an output of an emission laser to be emitted to have an output value corresponding to a thickness of the foreign matter, and removes the foreign matter by irradiating the foreign matter with a controlled laser to clean the surface of the rotary roller; and a speed control unit configured to control at least one of a rotation speed of the rotary roller and a laser response time, which is a time required to control the output of the emission laser to have the output value corresponding to the thickness of the foreign matter after receiving the reflection laser, such that the rotation speed of the rotary roller and the laser response time satisfies a relational expression $V \times S \leq D/1000$ ($D \geq 0.1$ mm), where the rotation speed of the rotary roller is V (m/sec), the laser response time is S (sec), and a length of the foreign matter in a circumferential direction of the rotary roller is D (mm).

According to the second aspect of the invention, similarly to the first aspect, when foreign matter adhered to the rotary roller is detected, the detected foreign matter can be removed before reaching a position below the molten metal discharge port, and as a result, a high-quality quenched ribbon can be manufactured efficiently.

The detector, the laser output value control unit, and the speed control unit according to the second aspect may be built into a single computer together with a CPU and connected to each other by a bus or the like to be capable of exchanging data, or may be built respectively into separate computers and operated by dedicated CPUs so as to exchange data either wirelessly or over a wire.

In the second aspect, the laser output value control unit may be configured to remove the foreign matter following detection of the foreign matter by the detector before the foreign matter reaches a position in which the molten metal is supplied onto the rotary roller. Further, in the second aspect, the speed control unit may be configured to control the at least one of the rotation speed of the rotary roller and the laser response time such that the rotation speed of the rotary roller and the laser response time are maintained to satisfy the relational expression $V \times S \leq D/1000$ ($D \geq 0.1$ mm) after detection of the foreign matter until removal of the foreign matter.

In the second aspect, the laser output value control unit may be configured to calculate the thickness of the foreign matter on the basis of the reflection laser, and control the output of the emission laser in accordance with the calculated thickness of the foreign matter, or the laser output value control unit may be configured to determine the thickness of the foreign matter in accordance with an energy of the reflection laser, and control the output of the emission laser in accordance with the determined thickness of the foreign matter.

Further, in the second aspect, the laser may be a pico-wave laser or a laser having a shorter wavelength than the pico-wave laser.

Furthermore, in a case where the discharge port of the furnace is movable in the width direction of the rotary roller, the laser oscillator, the detector that receives the reflection laser, and the laser output value control unit that irradiates the foreign matter with a laser having an increased output value may be movable in an identical direction to the movement direction of the discharge port in synchronization with the movement of the discharge port.

What is claimed is:

1. A rotary roller surface cleaning method for a quenched ribbon manufacturing apparatus including: a furnace that contains a molten metal constituted by a rare earth magnet material; and a rotary roller than is supplied with the molten metal from the furnace during rotation and quenches the supplied molten metal to manufacture a quenched ribbon for a rare earth magnet, the method comprising:

emitting laser light onto a surface of the rotary roller;

receiving a reflection laser light obtained when the laser light emitted onto the surface of the rotary roller is reflected;

measuring an intensity of the reflection laser light;

detecting foreign matter on the surface of the rotary roller on the basis of the intensity of the reflection laser light;

when the foreign matter is detected, controlling an output of an emission laser to be emitted to have an output value corresponding to a thickness of the foreign matter;

removing the foreign matter by irradiating the foreign matter with controlled laser light to clean the surface of the rotary roller; and adjusting at least one of a rotation speed of the rotary roller and a laser response time, which is a time required to control the output of the emission laser to have the output value corresponding to the thickness of the foreign matter after receiving the reflection laser light, such that the rotation speed of the rotary roller and the laser response time satisfy a relational expression $V \times S \leq D/1000$ when $D \geq 0.1$ mm, where the rotation speed of the rotary roller is V (m/sec), the laser response time is S (sec), and a length of the foreign matter along a circumferential direction of the rotary roller is D (mm).

2. The rotary roller surface cleaning method according to claim 1, wherein removal of the foreign matter following detection of the foreign matter is performed before the foreign matter reaches a position in which the molten metal is supplied onto the rotary roller.

3. The rotary roller surface cleaning method according to claim 1, wherein the at least one of the rotation speed of the rotary roller and the laser response time is adjusted such that the rotation speed of the rotary roller and the laser response time are maintained to satisfy the relational expression $V \times S \leq D/1000$ when $D \geq 0.1$ mm and after detection of the foreign matter until removal of the foreign matter.

4. The rotary roller surface cleaning method according to claim 1, wherein:

the thickness of the foreign matter is calculated on the basis of the reflection laser light, and the output of the emission laser is controlled in accordance with the calculated thickness of the foreign matter.

5. The rotary roller surface method according to claim 1, wherein:

the thickness of the foreign matter is determined in accordance with an energy of the reflection laser light, and the output of the emission laser is controlled in accordance with the determined thickness of the foreign matter.

6. The rotary roller surface cleaning method according to claim 1, wherein the emission laser is a pico-wave laser or a laser having a shorter wavelength than a pico-wave laser.

7. A rotary roller surface cleaning apparatus for a quenched ribbon manufacturing apparatus including: a furnace that contains a molten metal constituted by a rare earth magnet material; and a rotary roller that is supplied with the molten metal from the furnace during rotation and quenches the supplied molten metal to manufacture a quenched ribbon for a rare each magnet, the apparatus comprising:

a laser oscillator that emits laser light onto a surface of the rotary roller;

a detector that receives a reflection laser light obtained when the laser light emitted onto the surface of the rotary roller is reflected, measures an intensity of the reflection laser light, and detects foreign matter on the surface of the rotary roller on the basis of the intensity of the reflection laser light;

a laser output value control unit configured to, when the foreign matter is detected by the detector, control an output of an emission laser to be emitted to have an output value corresponding to a thickness of the foreign matter, and wherein the cleaning apparatus is configured to remove the foreign matter by irradiating the foreign matter with a controlled laser to clean the surface of the rotary roller; and a speed control unit configured to control at least one of a rotation speed of the rotary roller and a laser response time, which is a time required to control the output of the emission laser to have the output valve corresponding to the thickness of the foreign matter after receiving the reflection laser light, such that the rotation speed of the rotary roller and the laser response time satisfies a relational expression $V \times S \leq D/1000$ when $D \geq 0.1$ mm where the rotation speed of the rotary roller is V (m/sec), the laser response time is S (sec), and a length of the foreign matter in a circumferential direction of the rotary roller is D (mm).

8. The rotary roller surface cleaning apparatus according to claim 7, wherein the laser output value control unit is configured to remove the foreign matter following detection of the foreign matter by the detector before the foreign matter reaches a position in which the molten metal is supplied onto the rotary roller.

9. The rotary roller surface cleaning apparatus according to claim 7, wherein the speed control unit is configured to control the at least one of the rotation speed of the rotary roller and the laser response time such that the rotation speed of the rotary roller and the laser response time are maintained to satisfy the relational expression $V \times S \leq D/1000$ when $D \geq 0.1$ mm after detection of the foreign matter until removal of the foreign matter.

10. The rotary roller surface cleaning apparatus according to claim 7, wherein the laser output value control unit is configured to calculate the thickness of the foreign matter on the basis of the reflection laser light, and control the output of the emission laser in accordance with the calculated thickness of the foreign matter.

11. The rotary roller surface cleaning apparatus according to claim 7, wherein the laser output value control unit is configured to determine the thickness of the foreign matter in accordance with an energy of the reflection laser light, and control the output of the emission laser in accordance with the determined thickness of the foreign matter.

12. The rotary roller surface cleaning apparatus according to claim 7, wherein the laser is a pico-wave laser or a laser having a shorter wavelength than a pico-wave laser.

* * * * *